US008225967B2

(12) United States Patent
Dodd

(10) Patent No.: US 8,225,967 B2
(45) Date of Patent: Jul. 24, 2012

(54) HINGED PUMP MECHANISMS AND METHODS OF USING THE SAME

(75) Inventor: Joseph K. Dodd, Lee's Summit, MO (US)

(73) Assignee: MeadWestvaco Corporation, Richmond, VA (US)

( * ) Notice: Subject to any disclaimer, the term of this patent is extended or adjusted under 35 U.S.C. 154(b) by 731 days.

(21) Appl. No.: 12/358,492

(22) Filed: Jan. 23, 2009

(65) Prior Publication Data

US 2009/0188947 A1 Jul. 30, 2009

Related U.S. Application Data

(60) Provisional application No. 61/023,302, filed on Jan. 24, 2008.

(51) Int. Cl.

| | |
|---|---|
| ***B65D 88/54*** | (2006.01) |
| ***B05B 11/00*** | (2006.01) |
| ***B05B 1/30*** | (2006.01) |
| ***A62C 11/00*** | (2006.01) |

(52) U.S. Cl. ..... 222/321.8; 22/379; 22/383.3; 239/333; 239/587.4; 239/587.3

(58) Field of Classification Search ..... 222/321.8, 222/321.7, 321.9, 320, 321.1, 372, 379, 383.3; 239/333, 334, 587.4, 587.3

See application file for complete search history.

(56) References Cited

U.S. PATENT DOCUMENTS

| | | | | |
|---|---|---|---|---|
| 3,030,033 | A * | 4/1962 | Rosenkranz | 239/460 |
| 3,921,912 | A * | 11/1975 | Hayes | 239/242 |
| 4,035,004 | A * | 7/1977 | Hengesbach | 285/146.1 |
| 4,061,250 | A * | 12/1977 | Tada | 222/321.8 |
| 4,077,549 | A * | 3/1978 | Beard | 222/321.8 |
| 4,082,223 | A * | 4/1978 | Nozawa | 239/333 |
| 4,434,917 | A * | 3/1984 | Saito et al. | 222/383.1 |
| 4,456,153 | A * | 6/1984 | Meshberg | 222/321.8 |
| 4,506,805 | A * | 3/1985 | Marcon | 222/153.13 |
| 4,643,338 | A * | 2/1987 | Iizuka | 222/321.8 |
| 5,975,375 | A * | 11/1999 | Renault et al. | 222/321.8 |
| 6,027,041 | A * | 2/2000 | Evans | 239/334 |
| 6,491,238 | B1 * | 12/2002 | Swanson et al. | 239/587.4 |
| 6,851,625 | B1 * | 2/2005 | Kuo | 239/333 |
| 7,097,122 | B1 * | 8/2006 | Farley | 239/553 |
| 7,124,915 | B2 * | 10/2006 | Restive | 222/153.11 |
| 7,249,692 | B2 * | 7/2007 | Walters et al. | 222/153.11 |
| 7,556,179 | B2 * | 7/2009 | Yang et al. | 222/321.8 |
| 2005/0098584 | A1 * | 5/2005 | Do Rosario | 222/321.7 |

* cited by examiner

*Primary Examiner* — Kevin P Shaver
*Assistant Examiner* — Stephanie E Williams
(74) *Attorney, Agent, or Firm* — MWV Intellectual Property Group

(57) ABSTRACT

A dispenser may include a hinged pump mechanism which allows a pump head to rotate about the hinge mechanism during actuation of a pump.

10 Claims, 4 Drawing Sheets

HINGED PUMP MECHANISMS AND METHODS OF USING THE SAME

CROSS-REFERENCE TO RELATED APPLICATIONS

This application claims the benefit of U.S. Provisional Application No. 61/023,302, entitled "HINGED PUMP MECHANISMS AND METHODS OF USING THE SAME," filed 24 Jan. 2008, and incorporates the same herein by reference in its entirety.

BACKGROUND OF THE INVENTION

1. Field of the Invention

Embodiments of the invention relate to pump mechanisms and more particularly to leveraged and/or hinged pump mechanisms.

2. State of the Art

Pump devices are well known and pump devices for dispersing personal care products such as soaps, lotions, make-up, and other liquid or viscous formulations are common in many households. Typically, pump devices may be attached to a container containing a liquid or other viscous product that a user may wish to store and deliver through a pump attached to the container. A conventional pump may include a dip tube connected to a pump body which may house one or more valves, an actuator, a product flow path, and a spring or other mechanism which aids in the pumping process. The pump may be attached to a container in many ways, including with the use of a cap such as a screw-type cap or bayonet cap which secures the pump to the container. A head or spout is also typically attached to the pump to provide a path through which product pumped from the container may flow before being delivered to a user. The head may also provide an aesthetically pleasing look to the pump.

While many different types of pump devices are available, new pumps are often desired in the marketplace to create an iconic look or feel for the pump. In addition, specifications for pumps are always changing, requiring that pump devices and the heads placed on such devices meet stringent top-load specifications and drop-test specifications. Therefore, new pump devices may be desirous.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following description of the invention when read in conjunction with the accompanying drawings in which:

DETAILED DESCRIPTION OF THE INVENTION

Figure 1:
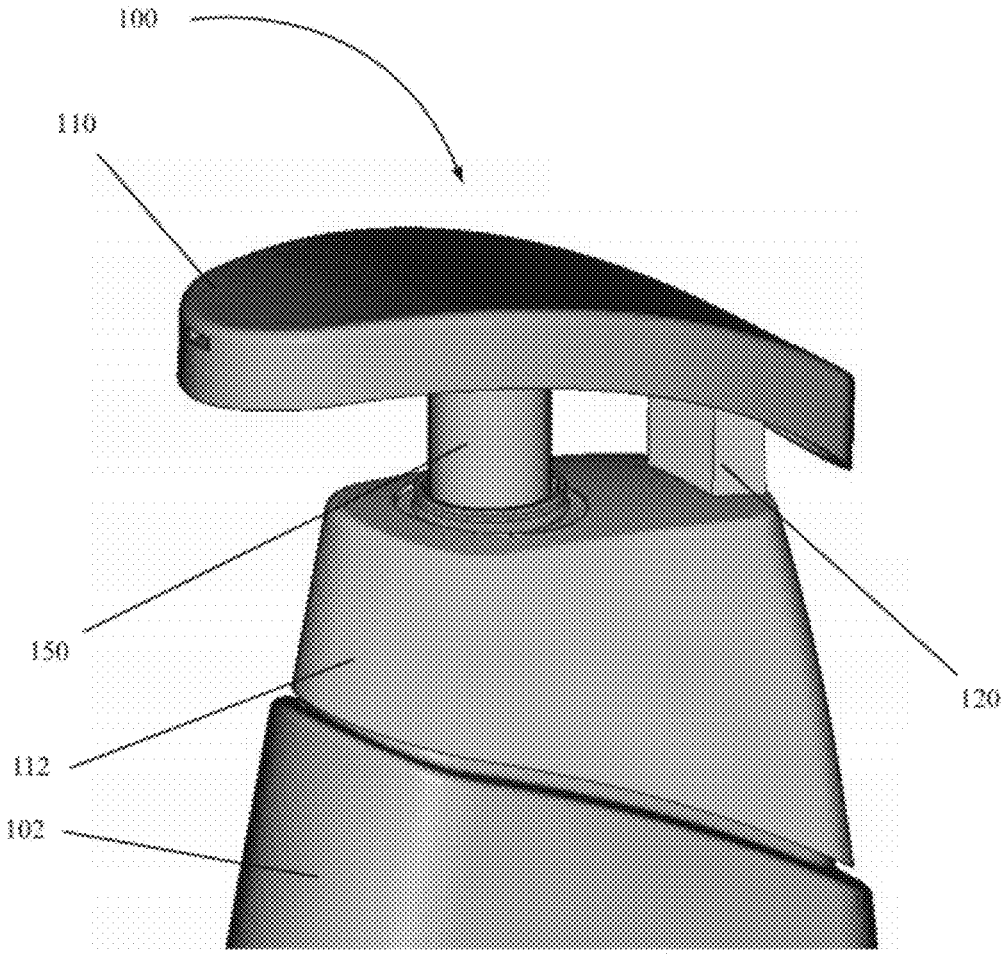
FIG. 1 illustrates a dispenser according to various embodiments of the invention.

FIG. 1 illustrates a dispenser 100 having a pump mechanism according to certain embodiments of the invention which is mounted to a container 102. The dispenser 100 may include a pump head 110, a pump 150, at least one hinge mechanism 120, and a container connection 112.

A pump head 110 according to embodiments of the invention may include any shape or design which allows a fluid or viscous product to flow through at least one chamber, pathway, or route through the pump head 110, from the pump mechanism or pump 150. The pump head 110 may include one or more parts and may be made of any suitable material, such as metal, plastic, wood, or any combination thereof. The pump head 110 may be connected to the pump 150 in any way such that the pump 150 may supply a fluid or viscous product to the pump head 110. According to some embodiments of the invention, the pump head may include a hinge mating mechanism for mating with the hinge mechanism 120.

According to embodiments of the invention, a pump 150 may include any pump 150 housing a pump mechanism or which is capable of pumping a fluid or viscous product. The pump 150 may also be capable of pumping a powder or a fluid-powder combination. For instance, a pump 150 from a conventional pump may be altered and adapted to provide a pump 150 according to embodiments of the invention.

According to various embodiments of the invention, a hinge mechanism 120 may also be provided. The hinge mechanism 120 may provide a fulcrum point about which the pump head 110 may rotate when actuated. For instance, the hinge mechanism 120 illustrated in FIG. 1 includes a rectangular shaped post about which the pump head 110 may rotate or move. The pump head 110 and the hinge mechanism 120 may be connected in such a manner that the hinge mechanism 120 may provide a fulcrum point about which the pump head 110 may be moved during actuation of the pump 150.

According to embodiments of the invention, the container connection 112 may include any connection device, mechanism, or means for securing a pump 150 in relation to the container 102. For example, the container connection 112 may include a conventional screw-type connection which may be secured to a container 102 by screwing the container connection 112 onto corresponding threads of the container 102. The container connection 112 may also include a snap-fit or bayonet-type connection wherein the container connection 112 may be forced onto the container 102 where snap-fitments or bayonet-fitments mate with corresponding fitments on the container 102 to secure the container connection 112 to the container 102. As illustrated in FIG. 1, the container connection 112 may also serve as a decorative shroud wherein the container connection 112 may add aesthetically pleasing characteristics or qualities to the dispenser 100. For instance, the container connection 112 may be snap-fit or otherwise connected to the container 102 such that the curves match corresponding curves in the container 102 to create a pattern in the connection between the container 102 and the container connection 112. The connection between the container 102 and the container connection 112 may be a removable connection, a fixed, permanent connection, or any other type of connection as desired.

Figure 2:
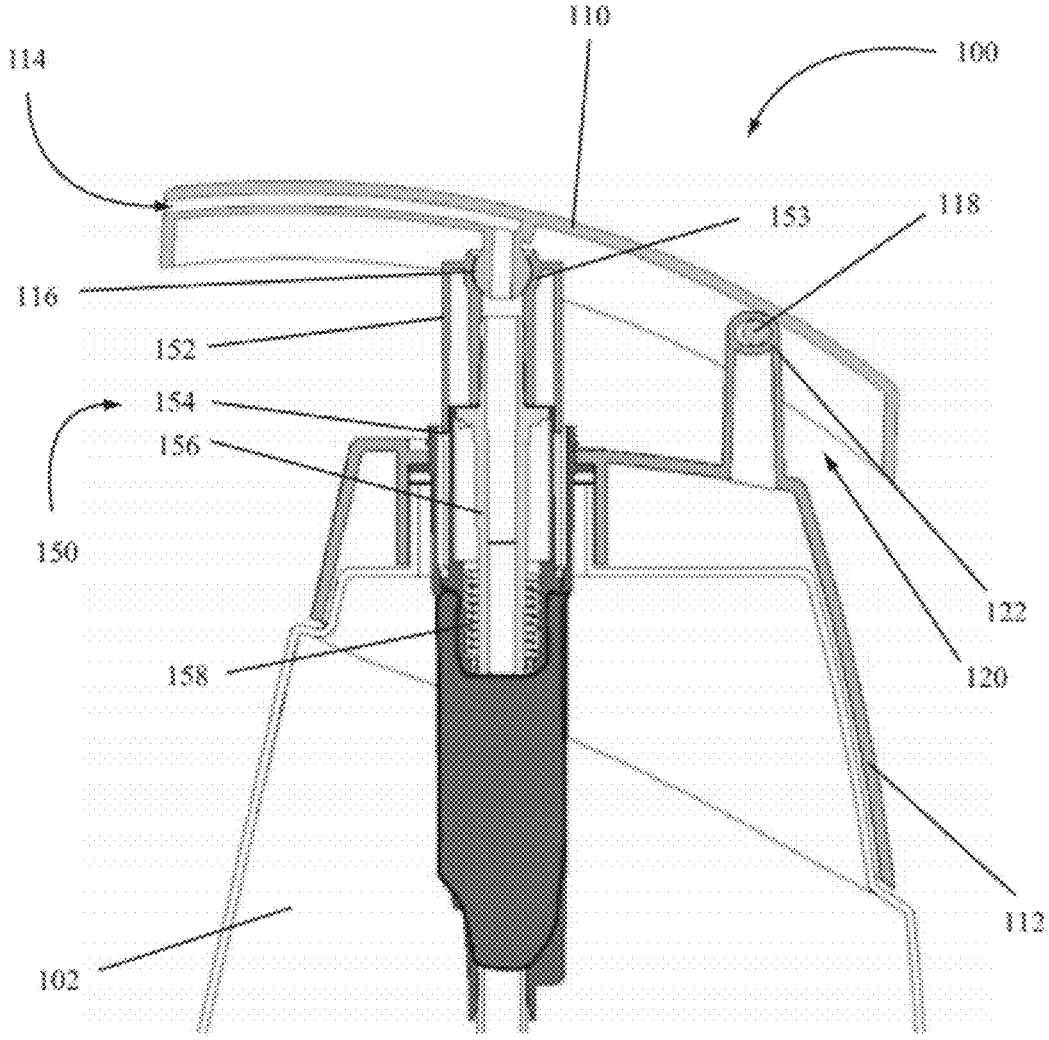
FIG. 2 illustrates a cross-sectional view of a dispenser having a pump in a non-actuated state according to embodiments of the invention.

A dispenser 100 according to various embodiments of the invention is illustrated in FIG. 2. According to embodiments of the invention, the dispenser 100 may include a container 102 to which a container connection 112 is attached. The container connection 112, or shroud, may help attach a pump 150 to the container 102. The pump 150 may include any type of pump 150 desirable. The pump 150 may also be attached or otherwise connected to a pump head 110. The pump head 110 may include a hinge which allows the pump head 110 to at least partially rotate about an axis created by the hinge mechanism 120.

According to embodiments of the invention, the pump 150 may include any type of pump 150. As illustrated in FIG. 2, the pump 150 may include an accumulator 154. A piston stem 156 may be positioned within the accumulator 154 as in typical pumps and may be used to pump product through the pump 150. One or more springs 158 may also be contained within the accumulator 154. One or more valves (not shown) within the accumulator 154 may allow the flow of product from the container 102 through the pump 150. In some instances, the product from a container 102 may flow through a dip tube (not shown) into the pump 150.

A pump 150 according to embodiments of the invention may also include a head adaptor 152. The head adapter 152 may mate with or be confined by the accumulator 154 and may move with respect to the accumulator 154. The head adaptor 152 may also be configured to activate or move the piston stem 156. According to certain embodiments of the invention, the head adaptor 152 may also include a head seat 153. The head seat 153 may mate with or merge with a head connection seal 116.

According to other embodiments of the invention, the head adaptor 152 may be formed in the accumulator 154 or in the piston stem 156, obviating the need for a separate head adaptor 152. In other embodiments of the invention, the head adaptor 152 may be integrated with the pump head 110 or with another part of the dispenser 100.

According to embodiments of the invention, the head connection seal 116 may be free to at least partially rotate in the head seat 153. The head connection seal 116 may also include a passageway through the head connection seal 116 connecting the pump 150 with the pump head 110. The connection through the head connection seal 116 may allow product pumped through the pump 150 to flow from the pump 150 into an outlet passageway 114 in the pump head 110. In some embodiments of the invention, the connection through the head connection seal 116 remains open to the pump 150 throughout the actuation stroke of the pump 150. According to other embodiments of the invention, the head connection seal 116 may be configured such that as the pump 150 is actuated, the connection through the head connection seal 116 to the pump 150 is gradually closed. The closing of the connection during actuation may ensure that only a pre-determined amount of product is distributed with each actuation of the pump 150.

According to embodiments of the invention, as the pump head 110 rotates about the hinge mechanism 120, the head connection seal 116 rotates in the head seat 153. However, the rotation may still allow product to flow from the pump 150 to the pump head 110 to be dispensed from the dispenser 100. Actuation of the pump 150 may be accomplished by putting pressure on or applying a force to the pump head 110. As the force is applied, the pump head 110 engages the piston stem 156 and actuates the flow of a product from the pump 150. In addition, as the force is applied, a portion of the pump head 110 rotates about the hinge mechanism 120.

According to certain embodiments of the invention, the hinge mechanism 120 may include an axle 118 and an axle mating piece 122. An axle 118 connected to or integral with the pump head 110 may be fitted in or moveably fixed to an axle mating piece 122 formed in the hinge mechanism 120. The axle 118 and axle mating piece 122 may be configured to allow the pump head 110 to rotate about the axle 118 with respect to the remainder of the dispenser 100.

As illustrated in FIG. 2, additional space may be provided between the axle 118 and the axle mating piece 122 in some embodiments of the invention. The additional space may be provided to facilitate the movement of the pump head 110 during actuation of the pump 150. In some embodiments of the invention, movement within the hinge mechanism 120 may be necessary to allow for proper seating and movement of the head connection seal 116 in the head seat 153.

While the axle 118 and axle mating piece 122 illustrated in FIG. 2 provide a hinge mechanism 120 for the illustrated dispenser 100, it is understood that other hinge mechanisms 120 could easily be used with various embodiments of the invention. It is also understood that the axle 118 and axle mating piece 122 could be reversed such that the pump head 110 would include the axle mating piece 122 and the container connection 112 would support the axle 118.

Figure 3:
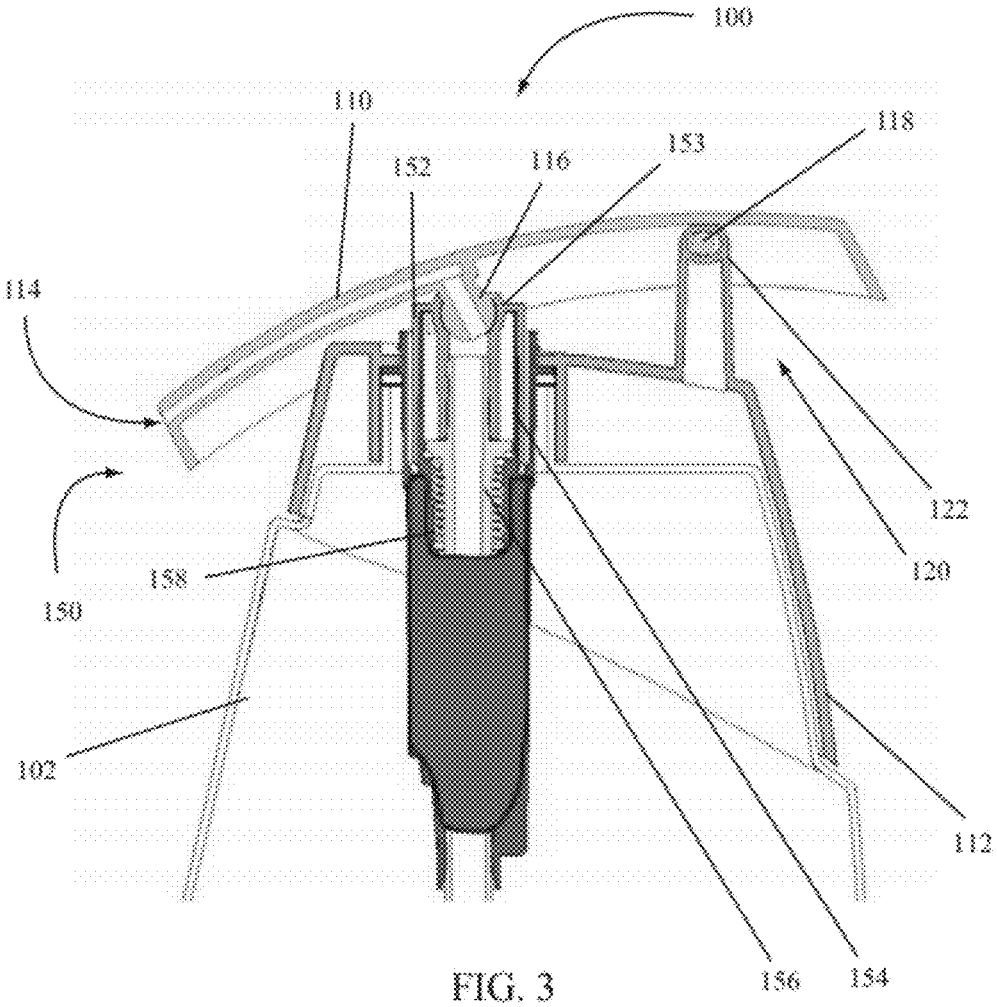
FIG. 3 illustrates a cross-sectional view of a dispenser having a pump in an actuated state according to embodiments of the invention.
Figure 4:
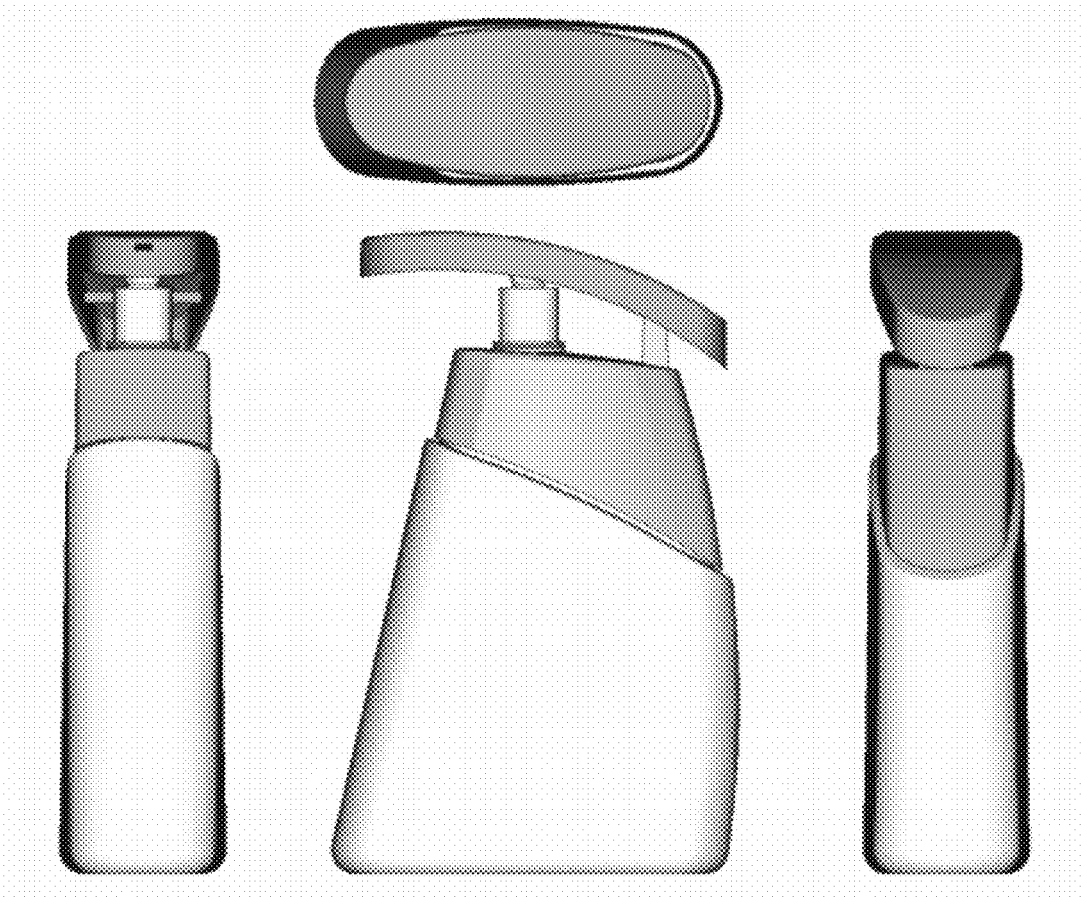
FIG. 4 illustrates a top view, a front view, a side view, and a rear view of a dispenser according to embodiments of the invention.

FIG. 3 illustrates the dispenser 100 of FIG. 2 wherein the pump 150 is in an actuated position. As illustrated, the pump head 110 is rotated about the hinge mechanism 120 and the pump head 110 has actuated the pump 150, depressing the piston stem 156 during pump 150 actuation. As the pump head 110 is depressed, head connection seal 116 rotates within the head seat 153. Product from the container 102 may be delivered through the pump 150 and through the pump head 110 during such actuation.

According to embodiments of the invention, the mating between the head connection seal 116 and the head seat 153 may be fluid tight, air tight, or sealed as desired. The connection between the head connection seal 116 and the head seat 153 may also allow the head connection seal 116 to rotate within the head seat 153.

As illustrated in FIG. 3, the axle 118 in the axle mating piece 122 may also move to accommodate rotation of the pump head 110.

According to embodiments of the invention, the pump head 110 may include undercuts, openings, or other configurations to allow the pump 150 to be fully actuated before the pump head 110 movement is hindered by contact with the container connection 112 or container 102. In other embodiments of the invention, the pump head 110 may include stops molded with the pump head to prevent further actuation of the pump 150 once a certain rotation or displacement of the pump head 110 has occurred. For example, multiple pump heads 110 could be molded and used with a dispenser 100 according to embodiments of the invention. Some of the pump heads 110 may include a stop which would stop the pump head 110 from further actuating the pump 150 once a first amount of product was dispensed. Other pump heads 110 may include a differently shaped stop which would stop the pump head 110 form further actuating the pump 150 once a second, different, amount of product was dispensed from the pump 150. In this manner, alterations to the amount of product dispersed from a dispenser 100 could be varied by changing the pump head 110 rather than by changing the entire pump 150.

According to other embodiments of the invention, the hinge mechanism 120 may also include stops or stop points which would regulate the amount of product dispensed from the pump 150 upon actuation. In still other embodiments of the invention, the hinge mechanism 120 or the pump head 110 may include moveable or adjustable components to alter the movement of the pump head 110 during actuation of the pump 150, allowing the user to select the amount of product which they desired from a single actuation of the pump 150.

While the dispensers 100 illustrated in FIGS. 2 and 3 include a head connection seal 116 integral with the pump head 110, the head connection seal 116 may be integral with the head adapter 152 or other portion of the pump 150. According to some embodiments of the invention, a head connection seal and head connection seal seat may be integral with either the pump head 110 or a portion of the pump 150. Head connection seals according to embodiments of the invention may also be shaped, configured, or otherwise positioned in any arrangement to allow the pump head 110 to rotate about a hinge mechanism 120 and to allow the fluid flow from a container 102 to be distributed by the dispenser 100.

According to some embodiments of the invention, the hinge mechanisms 120, the pump heads 110, or the combination of the hinge mechanisms 120 and pump heads 110 may be configured to withstand a certain desired top-loading force or impact force. For example, the hinge mechanism 120 may be configured to improve or increase the amount of force that the pump head 110 may withstand when dropped before breaking. According to some embodiments of the invention, the hinge mechanism 120 may also be configured to include a locking mechanism to prevent actuation of the pump 150 until desired.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A dispenser, comprising:
a container;
a pump connected to the container and a head seat connected to the pump;
a pump head connected to the head seat through a head connection seal
wherein the pump head is configured to dispense a product pumped from the container by the pump,
wherein the pump head rotates on a hinge mechanism and the head connection seal rotates about a horizontal axis in the head seat.

2. The dispenser of claim 1, wherein the pump comprises: an accumulator; a piston stem positioned within the accumulator; and at least one spring biasing the piston stem.

3. The dispenser of claim 1, further comprising a head adapter connected to the pump.

4. The dispenser of claim 3, wherein the pump further comprises an accumulator and wherein the head adapter is connected to the accumulator.

5. The dispenser of claim 3, wherein the pump further comprises: an accumulator; and a piston stem positioned within the accumulator, wherein the head adapter is connected to the accumulator.

6. The dispenser of claim 3, wherein the pump further comprises: an accumulator; and a piston stem positioned within the accumulator, wherein the head adapter is configured to activate the piston stem.

7. The dispenser of claim 1, wherein the head seat is located in a head adapter connected to the pump.

8. A dispenser, comprising:
a container;
a pump connected to the container, the pump further comprising:
an accumulator; and
a piston stem positioned in the accumulator;
a head adapter in communication with the pump;
a head seat configured in the head adapter;
a pump head moveably connected to the head seat through a head connection seal that rotates about a horizontal axis in the head seat; and
a hinge mechanism providing a fulcrum point about which the pump head may rotate.

9. The dispenser of claim 8, further comprising a fluid material in the container.

10. A dispenser, comprising:
a pump head;
a pump, comprising:
an accumulator;
a piston stem in the accumulator;
at least one valve in the accumulator;
a head adaptor in communication with the piston stem and the pump head; and
a head seat in the head adaptor;
a head connection seal rotatably seated in the head seat and providing a flow path from the pump to the pump head, the head connection seal rotating about a horizontal axis in the head seat; and
a hinge mechanism attached to the pump.

* * * * *